US011131184B1

(12) United States Patent
Alali et al.

(10) Patent No.: US 11,131,184 B1
(45) Date of Patent: Sep. 28, 2021

(54) METHOD AND SYSTEM FOR DETERMINING A DRILLING HAZARD CONDITION USING WELL LOGS

(71) Applicant: SAUDI ARABIAN OIL COMPANY, Dhahran (SA)

(72) Inventors: Ammar Alali, Dhahran (SA); Ali Aljishi, Dhahran (SA); Arturo Magana-Mora, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/861,759

(22) Filed: Apr. 29, 2020

(51) Int. Cl.

| | |
|---|---|
| ***G01V 3/00*** | (2006.01) |
| ***E21B 47/12*** | (2012.01) |
| ***E21B 47/04*** | (2012.01) |
| ***E21B 49/00*** | (2006.01) |

(52) U.S. Cl.
CPC ..... *E21B 47/12* (2013.01); *E21B 47/04* (2013.01); *E21B 49/003* (2013.01)

(58) Field of Classification Search
CPC ..... E21B 47/12; E21B 47/04; E21B 49/003
USPC ..... 340/854.4
See application file for complete search history.

(56) References Cited

U.S. PATENT DOCUMENTS

| | | | |
|---|---|---|---|
| 5,508,915 A | 4/1996 | Tsao et al. | |
| 6,732,052 B2 | 5/2004 | Macdonald et al. | |
| 8,401,795 B2 | 3/2013 | Kaageson-Loe et al. | |
| 10,364,662 B1 | 7/2019 | Basu et al. | |
| 2002/0103630 A1 | 8/2002 | Aldred et al. | |
| 2012/0016649 A1* | 1/2012 | Thambynayagam | E21B 43/12 703/10 |
| 2013/0025939 A1* | 1/2013 | Heliot | E21B 47/022 175/45 |
| 2013/0158877 A1 | 6/2013 | Bakke et al. | |

(Continued)

FOREIGN PATENT DOCUMENTS

| | | |
|---|---|---|
| CN | 101787897 B | 7/2010 |
| CN | 106121621 A | 11/2016 |

(Continued)

OTHER PUBLICATIONS

International Search Report issued in International Application No. PCT/US2020/036055, dated Jan. 22, 2021 (6 pages).

(Continued)

*Primary Examiner* — Tanmay K Shah
(74) *Attorney, Agent, or Firm* — Osha Bergman Watanabe & Burton LLP

(57) ABSTRACT

A method may include obtaining a plurality of historical drilling signals for a plurality of wells. At least one historical drilling signal among the plurality of historical drilling signals describes a drilling surface parameter that is measured during a respective drilling operation. The method may further include generating a first drilling signal while drilling a wellbore through a formation. The method may further include determining a first drilling correlation between the first drilling signal and the plurality of historical drilling signals. The method may further include determining a drilling hazard condition within a well path of the wellbore using the first drilling correlation. The method may further include adjusting, based on the drilling hazard condition, the well path of the wellbore.

17 Claims, 9 Drawing Sheets

(56) References Cited

U.S. PATENT DOCUMENTS

| | | | | |
|---|---|---|---|---|
| 2014/0116776 | A1* | 5/2014 | Marx | E21B 47/00 175/24 |
| 2015/0148919 | A1 | 5/2015 | Watson | |
| 2015/0300151 | A1* | 10/2015 | Mohaghegh | E21B 47/10 702/9 |
| 2015/0356450 | A1* | 12/2015 | Dursun | G06N 20/00 706/12 |
| 2017/0191359 | A1 | 7/2017 | Dursun et al. | |
| 2019/0169986 | A1 | 6/2019 | Storm, Jr. et al. | |

FOREIGN PATENT DOCUMENTS

| | | | |
|---|---|---|---|
| CN | 109779602 | A | 5/2019 |
| CN | 109826593 | A | 5/2019 |
| CN | 109919184 | A | 6/2019 |
| CN | 107451325 | B | 12/2019 |
| WO | 2013/066746 | A1 | 5/2013 |
| WO | 2014/066981 | A1 | 5/2014 |
| WO | 2019236339 | A1 | 12/2019 |

OTHER PUBLICATIONS

Written Opinion Report issued in International Application No. PCT/US2020/036055, dated Jan. 22, 2021 (7 pages).

* cited by examiner

METHOD AND SYSTEM FOR DETERMINING A DRILLING HAZARD CONDITION USING WELL LOGS

BACKGROUND

A subsurface formation may be determined using various measurements obtained through logging tools. These measurements may be used to calculate porosity, permeability, and other properties of a reservoir formation.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to a method that includes obtaining, by a computer processor, a plurality of historical drilling signals for a plurality of wells. At least one historical drilling signal among the plurality of historical drilling signals describes a drilling surface parameter that is measured during a respective drilling operation. The method further includes generating, by the computer processor, a first drilling signal while drilling a wellbore through a formation. The method further includes determining, by the computer processor, a first drilling correlation between the first drilling signal and the plurality of historical drilling signals. The method further includes determining, by the computer processor, a drilling hazard condition within a well path of the wellbore using the first drilling correlation. The method further includes adjusting, by the computer processor and based on the drilling hazard condition, the well path of the wellbore.

In general, in one aspect, embodiments relate to a system that includes a drilling system and a logging system that includes a plurality of drill bit logging tools. The logging system is coupled to the drilling system. The system further includes a control system coupled to a plurality of sensors. The system further includes a reservoir simulator that includes a computer processor. The reservoir simulator is coupled to the logging system and the drilling system. The reservoir simulator obtains a plurality of historical drilling signals for a plurality of wells. At least one historical drilling signal among the plurality of historical drilling signals describes a drilling surface parameter that is measured during a respective drilling operation. The reservoir simulator generates a first drilling signal while drilling a wellbore through a formation. The reservoir simulator determines a first drilling correlation between the first drilling signal and the plurality of historical drilling signals. The reservoir simulator determines a drilling hazard condition within a well path of the wellbore using the first drilling correlation. The reservoir simulator adjusts, based on the drilling hazard condition, the well path of the wellbore.

In general, in one aspect, embodiments relate to non-transitory computer readable medium storing instructions executable by a computer processor. The instructions obtain a plurality of historical drilling signals for a plurality of wells. At least one historical drilling signal among the plurality of historical drilling signals describes a drilling surface parameter that is measured during a respective drilling operation. The instructions generate a first drilling signal while drilling a wellbore through a formation. The instructions determine a first drilling correlation between the first drilling signal and the plurality of historical drilling signals. The instructions determine a drilling hazard condition within a well path of the wellbore using the first drilling correlation.

Other aspects of the disclosure will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

Like elements in the various figures are denoted by like reference numerals for consistency.

DETAILED DESCRIPTION

Specific embodiments of the disclosure will now be described in detail with reference to the accompanying figures.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (for example, first, second, third) may be used as an adjective for an element (that is, any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In general, embodiments of the disclosure include systems and methods for generating and using a model that is trained using augmented well data for determining drilling hazard condition(s) of the wellbore. In particular, training a model with ordinary well data may not capture the full range of geological and drilling scenarios involved in well data acquisition within a subsurface formation. To supplement ordinary well data, data augmentation processes provide the ability to expand the training dataset for a model that perceives its environment and takes actions that maximize its chance of successfully achieving its goals by incorporating adjustments within the well data to address the geological and drilling scenarios. However, in many situations, logging tool measurements may prove inaccurate due to unusual conditions within a wellbore. For example, a well log may be deformed, shifted, cut, and have noise inserted into the well log, in order to emulate various geological and drilling conditions experienced in acquired well log measurements.

Figure 1:
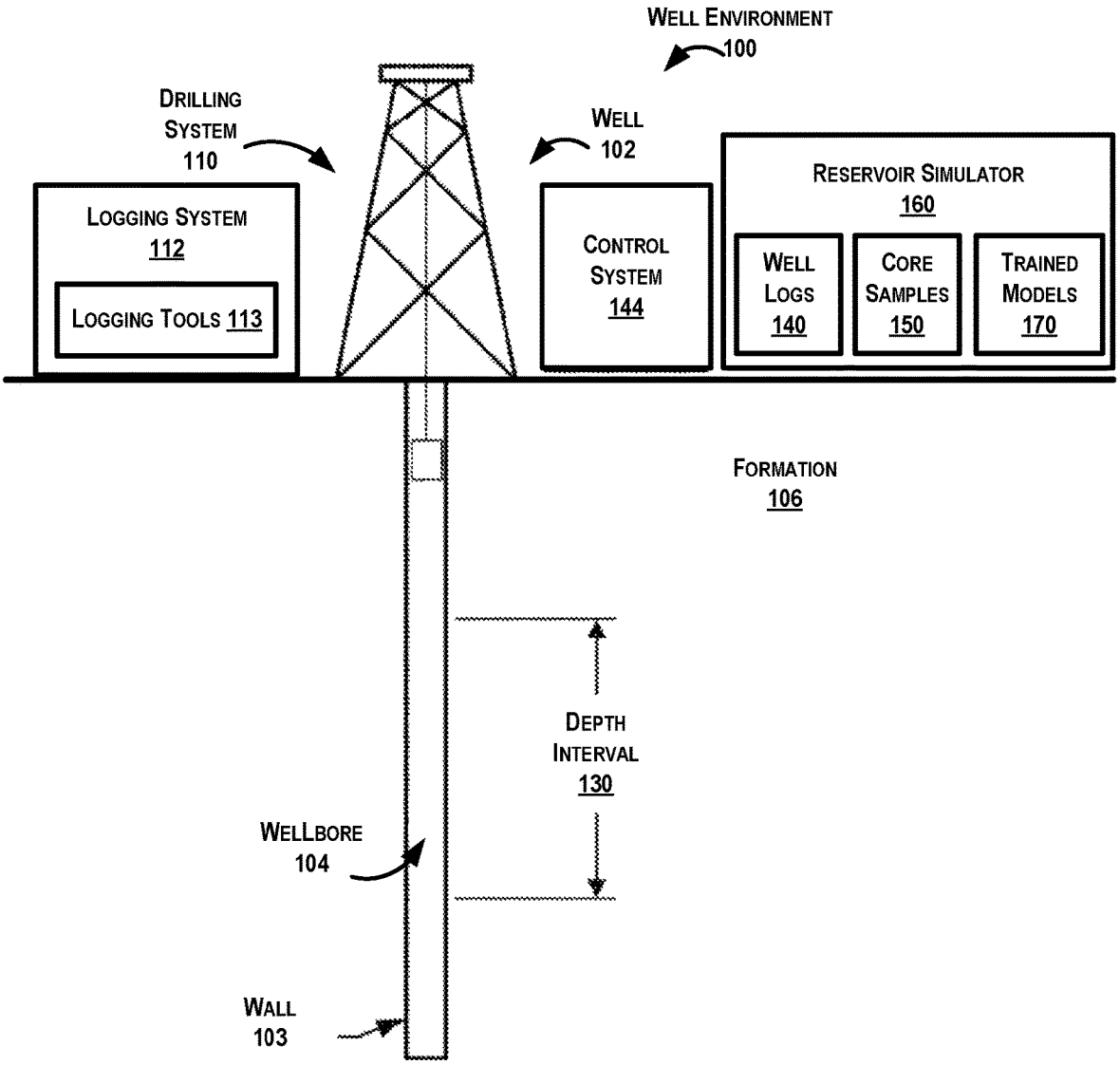
FIG. 1 shows a system in accordance with one or more embodiments.

FIG. 1 shows a schematic diagram in accordance with one or more embodiments. FIG. 1 illustrates a well environment (100) that may include a well (102) with a wall (103) having a wellbore (104) extending into a formation (106). The wellbore (104) may include a bored hole that extends from the surface into a target zone of the formation (106), such as a reservoir (not shown). The formation (106) may include various formation characteristics of interest, such as formation porosity, formation permeability, resistivity, water saturation, and free water level (FWL). Porosity may indicate how much void space exists in a particular rock within an area of interest in the formation (106), where oil, gas or water may be trapped. Permeability may indicate the ability of liquids and gases to flow through the rock within the area of interest. Resistivity may indicate how strongly rock or fluid within the formation (106) opposes the flow of electrical current. For example, resistivity may be indicative of the porosity of the formation (106) and the presence of hydrocarbons. More specifically, resistivity may be relatively low for a formation that has high porosity and a large amount of water, and resistivity may be relatively high for a formation that has low porosity or includes a large amount of hydrocarbons. Water saturation may indicate the fraction of water in a given pore space.

Keeping with FIG. 1, the well environment (100) may include a drilling system (110), a logging system (112), a control system (144), and a reservoir simulator (160). The drilling system (110) may include a drill string, drill bit or a mud circulation system for use in boring the wellbore (104) into the formation (106). The control system (144) may include hardware or software for managing drilling operations or maintenance operations. For example, the control system (144) may include one or more programmable logic controllers (PLCs) that include hardware or software with functionality to control one or more processes performed by the drilling system (110). Specifically, a programmable logic controller may control valve states, fluid levels, pipe pressures, warning alarms, or pressure releases throughout a drilling rig. In particular, a programmable logic controller may be a ruggedized computer system with functionality to withstand vibrations, extreme temperatures (for example, ~575° C.), wet conditions, or dusty conditions, for example, around a drilling rig. Without loss of generality, the term "control system" may refer to a drilling operation control system that is used to operate and control the equipment, a drilling data acquisition and monitoring system that is used to acquire drilling process and equipment data and to monitor the operation of the drilling process, or a drilling interpretation software system that is used to analyze and understand drilling events and progress. For more information on an example of a drilling system, see FIGS. 2A and 2B and the accompanying description.

The logging system (112) may include one or more logging tools (113), such as a nuclear magnetic resonance (NMR) logging tool or a resistivity logging tool, for use in generating well logs (140) of the formation (106). For example, a logging tool may be lowered into the wellbore (104) to acquire measurements as the tool traverses a depth interval (130) (for example, targeted reservoir section) of the wellbore (104). The plot of the logging measurements versus depth may be referred to as a "log" or "well log". Well logs (104) may provide depth measurements of the well (102) that describe such reservoir characteristics as formation porosity, formation permeability, resistivity, water saturation, and the like. The resulting logging measurements may be stored or processed or both, for example, by the control system (144), to generate corresponding well logs (140) for the well (102). A well log may include, for example, a plot of a logging response time versus true vertical depth (TVD) across the depth interval (130) of the wellbore (104).

Reservoir characteristics may be determined using a variety of different techniques. For example, certain reservoir characteristics can be determined via coring (for example, physical extraction of rock samples) to produce core samples (150) or logging operations (for example, wireline logging, logging-while-drilling (LWD) and measurement-while-drilling (MWD)). Coring operations may include physically extracting a rock sample from a region of interest within the wellbore (104) for detailed laboratory analysis. For example, when drilling an oil or gas well, a coring bit may cut plugs (or "cores") from the formation (106) and bring the plugs to the surface, and these core samples may be analyzed at the surface (for example, in a lab) to determine various characteristics of the formation (106) at the location where the sample was obtained.

Multiple types of logging techniques are available for determining various reservoir characteristics, and a particular form of logging may be selected and used based on the logging conditions and the type of desired measurements. For example, NMR logging measures the induced magnetic moment of hydrogen nuclei (that is, protons) contained within the fluid-filled pore space of porous media (for example, reservoir rocks). Thus, NMR logs may measure the magnetic response of fluids present in the pore spaces of the reservoir rocks. In so doing, NMR logs may measure both porosity and permeability as well as the types of fluids present in the pore spaces. For determining permeability, another type of logging may be used that is called spontaneous potential (SP) logging. SP logging may determine the permeabilities of rocks in the formation (106) by measuring the amount of electrical current generated between a drilling fluid produced by the drilling system (110) and formation water that is present in pore spaces of the reservoir rock. Porous sandstones with high permeabilities may generate more electricity than impermeable shales. Thus, SP logs may be used to identify sandstones from shales.

To determine porosity in the formation (106), various types of logging techniques may be used. For example, the logging system (112) may measure the speed that acoustic waves travel through rocks in the formation (106). This type of logging may generate borehole compensated (BHC) logs, which are also called sonic logs and acoustic logs. In general, sound waves may travel faster through shales than through sandstones because shales generally have greater density than sandstones. Likewise, density logging may also determine porosity measurements by directly measuring the density of the rocks in the formation (106). In addition, neutron logging may determine porosity measurements by assuming that the reservoir pore spaces within the formation (106) are filled with either water or oil and then measuring the amount of hydrogen atoms (that is, neutrons) in the pores. Furthermore, the logging system (112) may determine geological data for the well (102) by measuring corresponding well logs (140) and data regarding core samples (150) for the well (102).

Keeping with the various types of logging techniques, resistivity logging may measure the electrical resistivity of rock or sediment in and around the wellbore (104). In particular, resistivity measurements may determine what types of fluids are present in the formation (106) by measuring how effective these rocks are at conducting electricity. Because fresh water and oil are poor conductors of electricity, they have high relative resistivities. For example, an electrical resistivity of oil ranges from $4.5455\times10^6$ to $1.4925\times10^8$ ohm-meter and the electrical resistivity of fresh water aquifers is in the range of 10-100 ohm-meter. As such, resistivity measurements obtained via such logging can be used to determine corresponding reservoir water saturation ($S_w$).

Turning to the reservoir simulator (160), the reservoir simulator (160) may include hardware or software with functionality for generating one or more trained models (170) regarding the formation (106). For example, the reservoir simulator (160) may store well logs (140) and data regarding core samples (150), and further analyze the well log data, the core sample data, seismic data, or other types of data to generate or update the one or more trained models (170) having a complex geological environment. For example, different types of models may be trained, such as artificial intelligence, convolutional neural networks, deep neural networks, support vector machines, decision trees, inductive learning models, deductive learning models, and supervised learning models, and are capable of approximating solutions of complex non-linear problems. The reservoir simulator (160) may couple to the logging system (112) and the drilling system (110).

In some embodiments, the reservoir simulator (160) may include functionality for applying deep learning methodologies to precisely determine various subsurface layers. To do so, a large amount of interpreted data may be used to train a model. To obtain this amount of data, the reservoir simulator (160) may augment acquired data for various geological scenarios and drilling situations. For example, drilling logs may provide similar log signatures for a particular subsurface layer except where a well encounters abnormal cases. Such abnormal cases may include, for example, changes in subsurface geological compositions, well placement of artificial materials, or various subsurface mechanical factors that may affect logging tools. As such, the amount of well data with abnormal cases available to the reservoir simulator (160) may be insufficient for training a model. Therefore, in some embodiments, a reservoir simulator (160) may use data augmentation to generate a dataset that combines original acquired data with augmented data based on geological and drilling factors. This supplemented dataset may provide sufficient training data to train a model accordingly.

In some embodiments, the reservoir simulator (160) is implemented in a software platform for the control system (144). The software platform may obtain data acquired by the drilling system (110) and logging system (112) as inputs, which may include multiple data types from multiple sources. The software platform may aggregate the data from these systems (110, 112) in real time for rapid analysis. Real-time of or relating to computer systems in the software platform is defined as the actual time for updating information with instantaneous processing at the same rate as required by a user or necessitated by a process being controlled. In some embodiments, the control system (144), the logging system (112), or the reservoir simulator (160) may include a computer system that is similar to the computer system (700) described with regard to FIGS. 7A and 7B and the accompanying description.

Figure 2A:
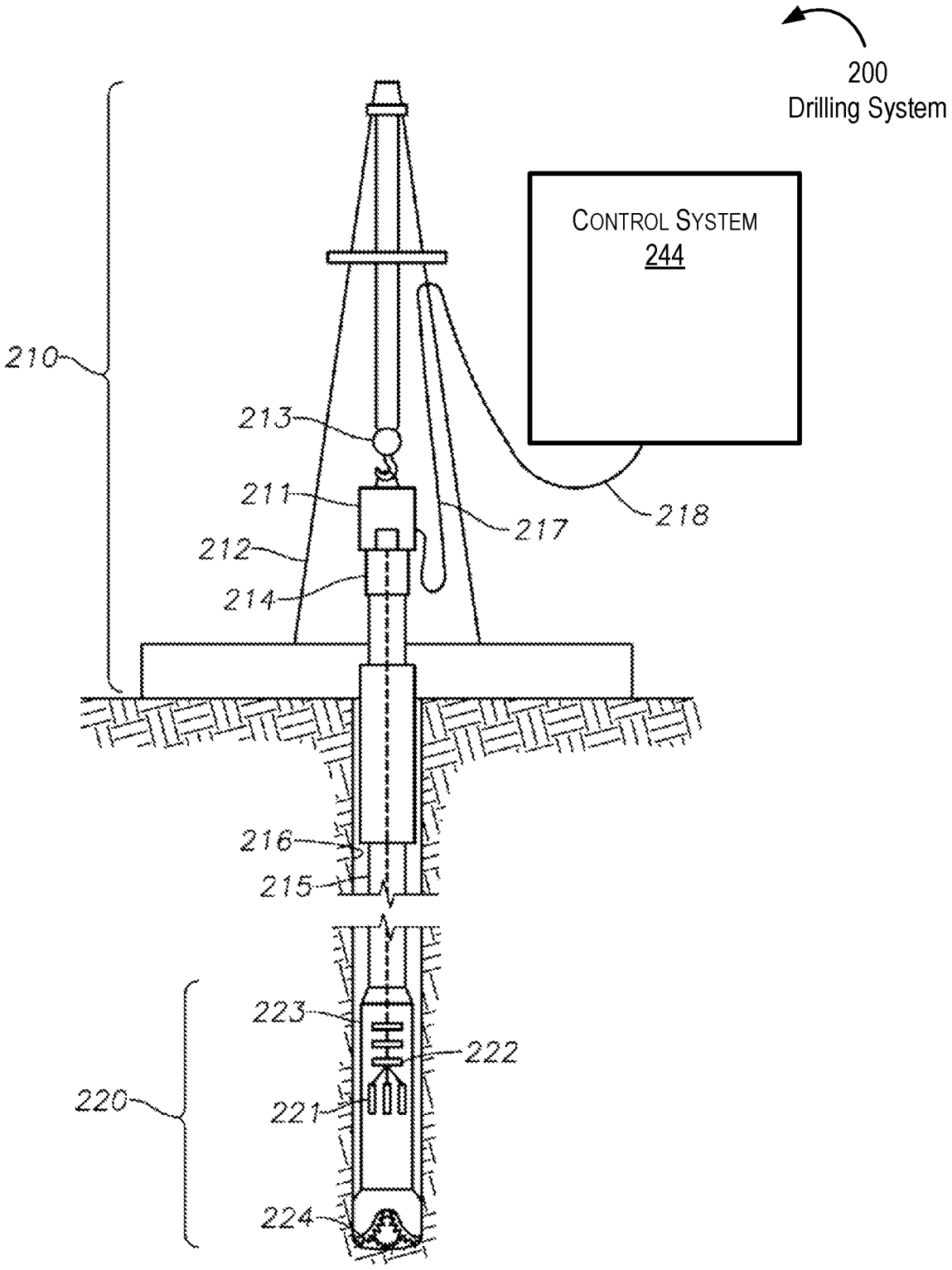
FIGS. 2A and 2B show systems in accordance with one or more embodiments.
Figure 2B:
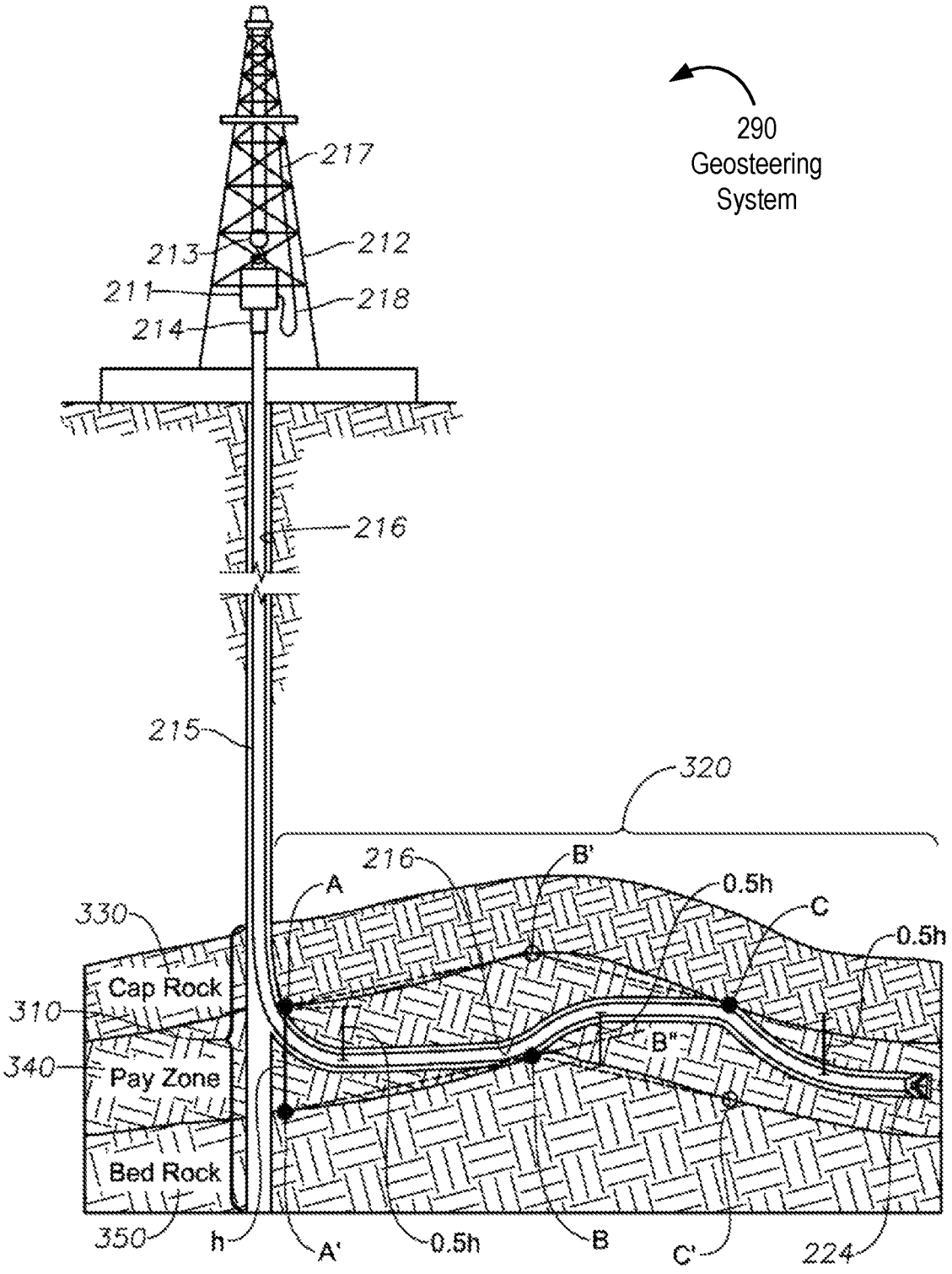

FIGS. 2A and 2B illustrate systems in accordance with one or more embodiments. As shown in FIG. 2A, a drilling system (200) may include a top drive drill rig (210) arranged around the setup of a drill bit logging tool (220). A top drive drill rig (210) may include a top drive (211) that may be suspended in a derrick (212) by a travelling block (213). In the center of the top drive (211), a drive shaft (214) may be coupled to a top pipe of a drill string (215), for example, by threads. The top drive (211) may rotate the drive shaft (214) so that the drill string (215) and a drill bit logging tool (220) cut the rock at the bottom of a wellbore (216). A power cable (217) supplying electric power to the top drive (211) may be protected inside one or more service loops (218) coupled to a control system (244). As such, drilling mud may be pumped into the wellbore (216) through a mud line, the drive shaft (214), or the drill string (215). The control system (244) may be similar to control system (144) described in FIG. 1 and the accompanying description.

Moreover, when completing a well, casing may be inserted into the wellbore (216). A wall of the wellbore (216) may require support, and thus the casing may be used for supporting the wall of the wellbore (216). As such, a space between the casing and the untreated wall of the wellbore (216) may be cemented to hold the casing in place. The cement may be pumped through a lower end of the casing and into an annulus between the casing and the wall of the wellbore (216). In some embodiments, a cementing plug may be used for pushing the cement from the casing. For example, the cementing plug may be a rubber plug used to separate cement slurry from other fluids, reducing contamination and maintaining predictable slurry performance. A displacement fluid, such as water, the drilling fluid or a weighted drilling mud, may be pumped into the casing above the cementing plug. This displacement fluid may be pressurized fluid that serves to urge the cementing plug downward through the casing to extrude the cement from the casing outlet and back up into the annulus.

As further shown in FIG. 2A, sensors (221) may be included in a sensor assembly (223), which is positioned uphold adjacent to a drill bit (224) and coupled to the drill string (215). Sensors (221) may also be coupled to a processor assembly (222) that includes a processor, memory, and an analog-to-digital converter for processing sensor measurements. For example, the sensors (221) may include acoustic sensors, such as accelerometers, measurement microphones, contact microphones, and hydrophones. Likewise, the sensors (221) may include other types of sensors, such as transmitters and receivers to measure resistivity or gamma ray detectors. The sensors (221) may include hardware or software or both for generating different types of well logs (such as acoustic logs or sonic longs) that may provide data about a wellbore on the formation, including porosity of wellbore sections, gas saturation, bed boundaries in a geologic formation, fractures in the wellbore or completion cement. If such well data is acquired during drilling operations (that is, logging-while-drilling), then the information may be used to make adjustments to drilling operations in real-time. Such adjustments may include rate of penetration (ROP), drilling direction, and altering mud weight.

In some embodiments, acoustic sensors may be installed in a drilling fluid circulation system of a drilling system (200) to record acoustic drilling signals in real-time. Drilling acoustic signals may transmit through the drilling fluid to be recorded by the acoustic sensors located in the drilling fluid circulation system. The recorded drilling acoustic signals may be processed and analyzed to determine well data, such as lithological and petrophysical properties of the rock formation. This well data may be used in various applications, such as steering a drill bit using geosteering, and casing shoe positioning.

The control system (244) may be coupled to the sensor assembly (223) in order to perform various program functions for up-down steering and left-right steering of the drill bit (224) through the wellbore (216). More specifically, the control system (244) may include hardware or software with functionality for geosteering a drill bit through a formation in a lateral well using sensor signals, such as drilling acoustic signals or resistivity measurements. For example, the formation may be a reservoir region, such as a pay zone, bed rock, or cap rock.

Turning to geosteering, geosteering may be used to position the drill bit (224) or drill string (215) relative to a boundary between different subsurface layers (for example, overlying, underlying, and lateral layers of a pay zone) during drilling operations. In particular, measuring rock properties during drilling may provide the drilling system (200) with the ability to steer the drill bit (224) in the direction of desired hydrocarbon concentrations. As such, a geosteering system may use various sensors located inside or adjacent to the drilling string (215) to determine different rock formations within a wellbore path. In some geosteering systems, drilling tools may use resistivity or acoustic measurements to guide the drill bit (224) during horizontal or lateral drilling. When resistivity measurements are employed, the upper and lower boundaries of a subsurface layer are computed from geological models using inversion techniques. A geological model may include predefined resistivity levels for various layers, such as a predefined resistivity of a pay zone within the subsurface. When sonic measurements are employed, the upper and lower boundaries of a layer may be calculated based on the travelling time of reflected sonic waves and the corresponding sonic velocity of formation rocks.

FIG. 2B illustrates some embodiments for steering a drill bit through a lateral pay zone using a geosteering system (290). The geosteering system (290) may include the drilling system (200) from FIG. 2A. In particular, the geosteering system (290) may include functionality for monitoring various sensor signatures (for example, an acoustic signature from acoustic sensors) that gradually or suddenly change as the wellbore path traverses a cap rock (230), a pay zone (240), and a bed rock (250). Because of the sudden change in lithology between the cap rock (230) and the pay zone (240), for example, a sensor signature of the pay zone (240) may be different from the sensor signature of the cap rock (230). When the drill bit (224) drills out of the pay zone (240) into the cap rock (230), an observed amplitude spectrum of a particular sensor type may change suddenly between the two distinct sensor signatures. In contrast, when drilling from the pay zone (240) downward into the bed rock (250), the observed amplitude spectrum may gradually change.

During the lateral drilling of the wellbore (216), preliminary upper and lower boundaries of a formation may be derived from a geophysical survey or an offset well obtained before drilling the wellbore (216). If a vertical section (235) of the well is drilled, an actual upper and lower boundaries of a formation layer (that is, actual pay zone boundaries (A, A')) and the pay zone thickness (that is, A to A') at the vertical section (235) may be determined. Based on this well data, an operator may steer the drill bit (224) through a lateral section (260) of the wellbore (216) in real time. In particular, a logging tool may monitor a detected sensor signature proximate the drill bit (224), where the detected sensor signature may continuously be compared against known sensor signatures, for example, of the cap rock (230), pay zone (240), and bed rock (250), respectively. As such, if the observed sensor signature of drilled rock is the same or similar to the sensor signature of the pay zone (240), the drill bit (224) may still be drilling in the pay zone (240). In this scenario, the drill bit (224) may continue to drill along its current path. If the observed sensor signature is same as or similar to the known sensor signatures of the cap rock (230) or the bed rock (250), respectively, then the control system (244) may determine that the drill bit (224) is drilling out of the pay zone (240) and into the upper or lower boundary of the pay zone (240). At this point, the vertical position of the drill bit (224) at this lateral position within the wellbore (216) may be determined and the upper and lower boundaries of the pay zone (240) may be updated, (for example, positions B and C in FIG. 2B). In some embodiments, the vertical position at the opposite boundary may be estimated based on the predetermined thickness of the pay zone (240), such as positions B' and C'.

Returning to FIG. 1, in some embodiments, a well path of a wellbore (104) is updated using a trained model (for example, one of the trained models (170)) by the control system (144). For example, a control system (144) may communicate geosteering commands to the drilling system (110) based on well data updates that are further adjusted by the reservoir simulator (160) using a trained model. As such, the control system (144) may generate one or more control signals for drilling equipment based on an updated well path design or reservoir model.

While FIGS. 1, 2A, and 2B shows various configurations of components, other configurations may be used without departing from the scope of the disclosure. For example, various components in FIGS. 1, 2A, and 2B may be combined to create a single component. As another example, the functionality performed by a single component may be performed by two or more components.

Figure 3:
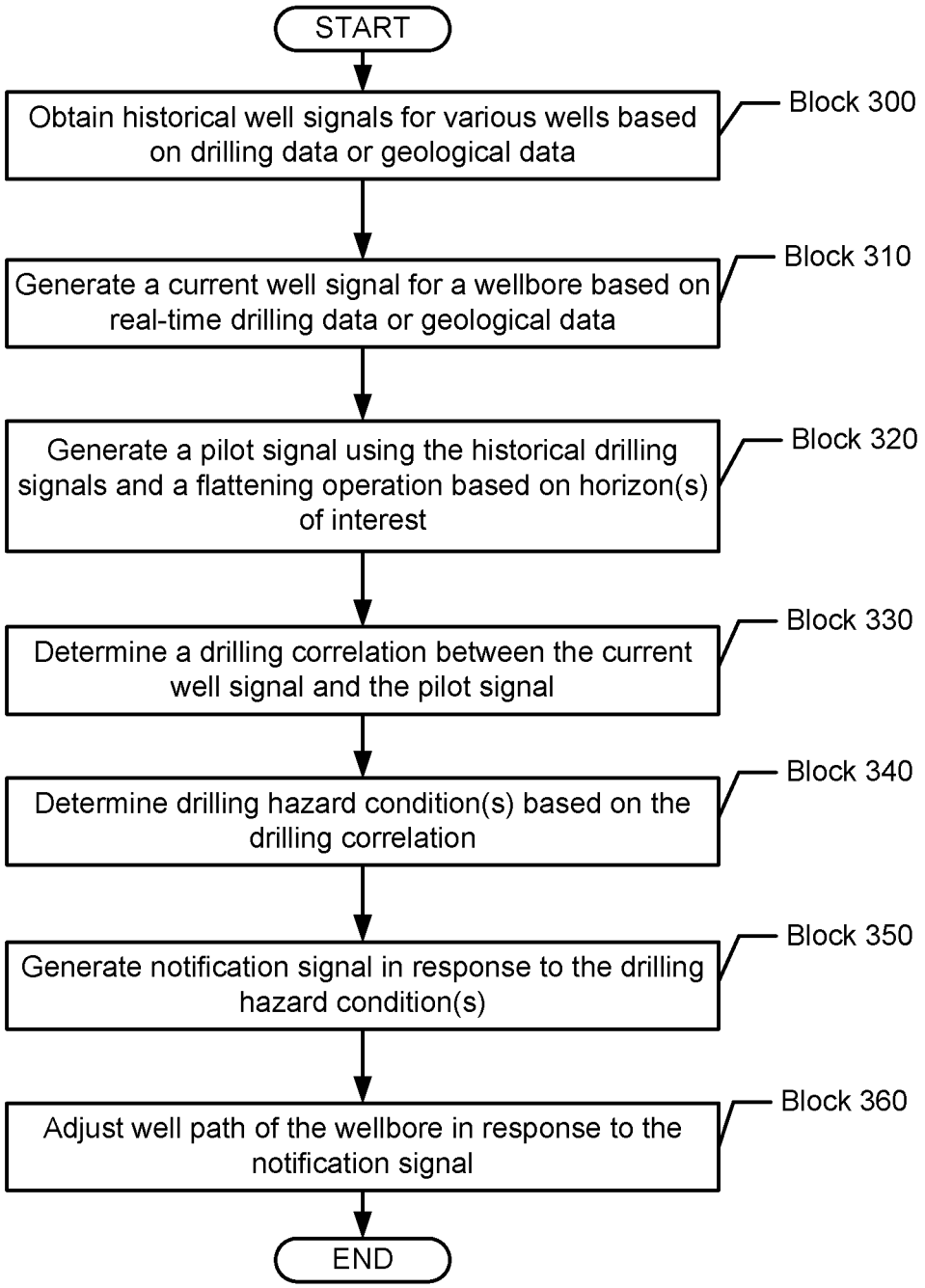
FIG. 3 shows a flowchart in accordance with one or more embodiments.

Turning to FIG. 3, FIG. 3 shows a flowchart in accordance with one or more embodiments. Specifically, FIG. 3 describes a general method for determining drilling hazard condition(s) and generating a notification signal in response to adjust well path of the wellbore. One or more blocks in FIG. 3 may be performed by one or more components (for example, reservoir simulator (160)) as described in FIGS. 1, 2A, and 2B. While the various blocks in FIG. 3 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In Block 300, acquired well data are obtained in accordance with one or more embodiments. For example, the acquired well data may correspond to well logs obtained for an interval of interest using a logging system (112) or logging tools (113) described previously in FIG. 1 and the accompanying description. For example, the acquired well data may include real-time drilling data, geological data or petro-physical data. The real-time drilling data describes a drilling surface parameter which may include all static drilling data and dynamic drilling data of the wellbore. For example, the static drilling data may include a size of the wellbore, a size of previous casing, or a location of the well. Similarly, the dynamic data may include, for example, a speed at which a drill bit can break a rock to deepen the wellbore (rate of penetration (ROP)), a torque produced by a drill to turn an object, standpipe pressure, an amount of downward force exerted on the drill bit provided by a plurality of drill collars in a drill assembly (weight on bit (WOB)), rotations per minute (RPM) or like. The interval of interest may be a particular depth interval within a formation, for example.

In Block 310, a current well signal for the wellbore is generated based on the real-time drilling data in accordance with one or more embodiments. For example, a first drilling signal is a time series and is generated while drilling a wellbore through the formation by processing and normalizing the real-time drilling data from any time or depth duplicates. Further, "event/hazard" markers are accurately placed to the processed and normalized real-time drilling data. The first drilling signal, which is also known as "signature," is created and it indicates certain behavior characterizing the well condition at a specific time.

In Block 320, a pilot signal is generated using one or more historic drilling signals and a flattening operation based on horizon(s) of interest in accordance with one or more embodiments. In particular, a plurality of historic drilling signals are functions of time. In some embodiments, the horizon of interest is determined within the formation to incorporate the real-time drilling data and historical drilling signals, for example, geological data from wells in the same field. A similar procedure is repeated for other events and horizons. Accordingly, in one or more embodiments, the flattening operation is performed based on the horizon of interest on the plurality of historical drilling signals to generate the pilot signals for the wellbore. In particular, the pilot signal is a linear curve which is a function of time within the respective drilling operation. The distinction of each pilot signal relies on previously marked drilling surface data from all the wells of a given field or region.

In Block 330, a drilling correlation between the current well signal and the pilot signal is determined in accordance with one or more embodiments. In some embodiments, the real-time drilling data, geological, and petro-physical data are treated as time series and are correlated with the pilot signature for the same horizon of interest. In some embodiments, the well log data for a depth of interest using the logging tool is generated while drilling the wellbore. The drilling correlation is then produced for each parameter of the acquired well data to produce and predict a certain event probability in a curve form in real time. For example, a first drilling correlation is generated by comparing the first drilling signal and the pilot signal. As such, a second drilling signal is generated using the well log data, which is converted into a time series. Likewise, a second drilling correlation is determined by using the second drilling signal in the reservoir simulator.

In Block 340, a drilling hazard condition(s) based on the drilling correlation is determined in accordance with one or more embodiments. For example, the first drilling correlation determines the drilling hazard condition within a well path of the wellbore using the first drilling correlation. Likewise, the second drilling correlation determines the drilling hazard condition within the well path of the wellbore using the second drilling correlation.

In Block 350, a notification signal is generated in accordance with one or more embodiments. In particular, once a certain threshold exceeds the event probability in the curve form (Block 320), a notification signal is generated regarding the possibility of the drilling hazard condition. In some embodiments, the threshold may have a fixed value and is defined by a user.

In Block 360, a well path of the wellbore is adjusted in response to the notification signal in accordance with one or more embodiments. In particular, upon reaching a hazardous-stage level, a drilling correlation operation clarifies and suggests a list of actions based on the nature of the detected hazard, guided by the common and established best drilling practices. In some embodiments, the list of suggested actions may generate a final probability of the drilling hazard event and flash during "warning" and "hazard" zones in response to the detection of the drilling hazard condition. In some embodiments, the geosteering system (290) of FIG. 2B may be employed for steering the drill bit through the lateral pay zone to adjust the well path of the wellbore.

Figure 4A:
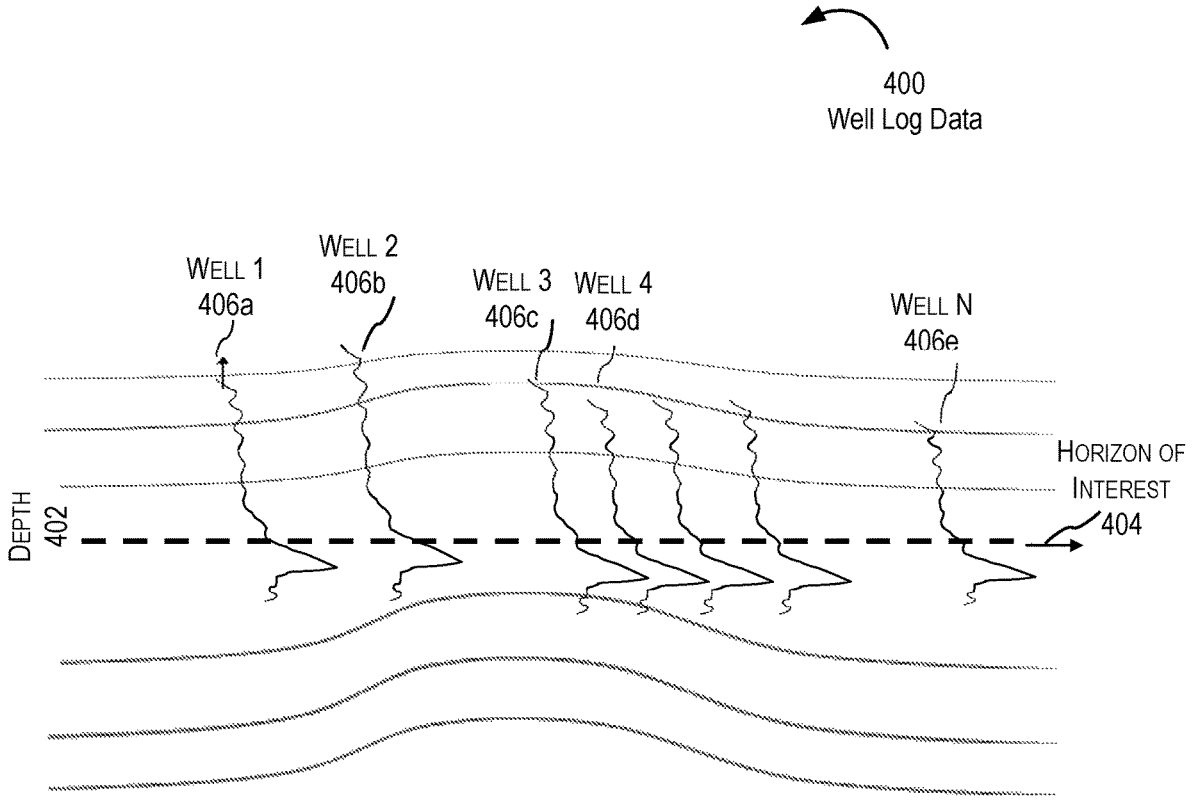
FIGS. 4A and 4B show an example in accordance with one or more embodiments.
Figure 4B:
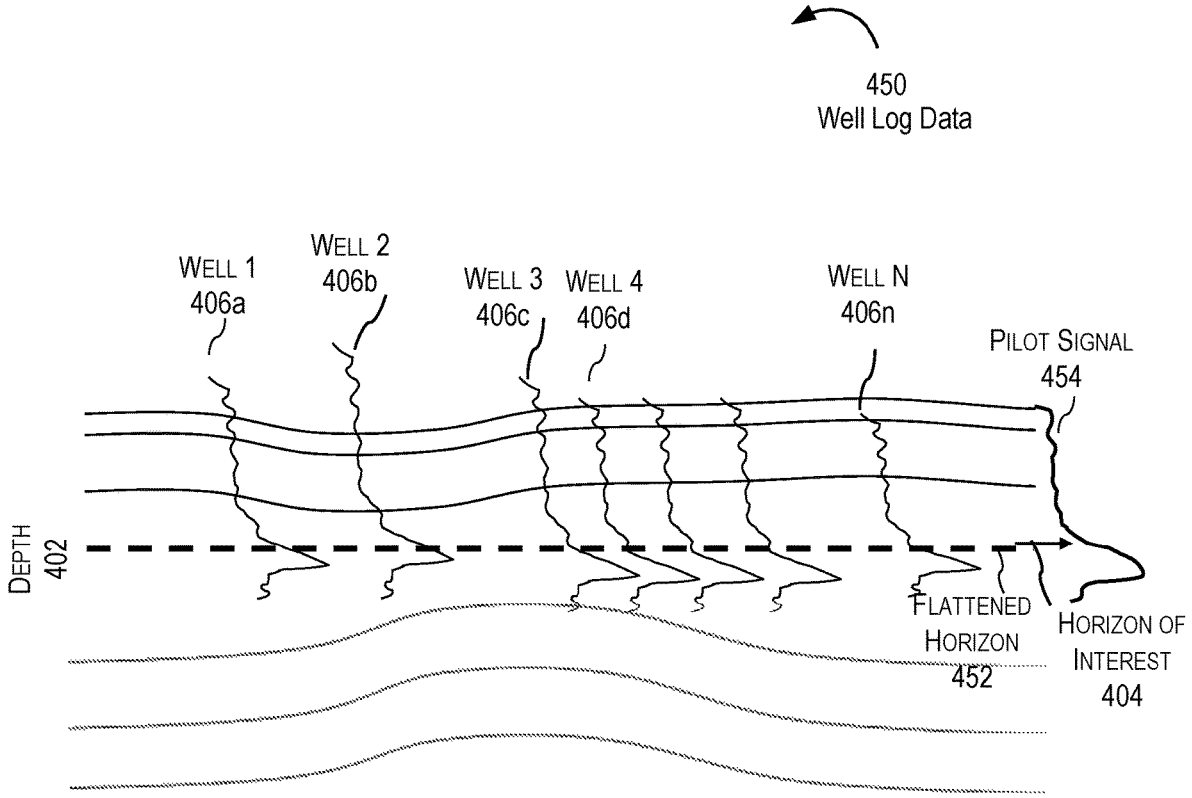

FIGS. 4A and 4B provide an example of generating the current well signal for the wellbore based on the real-time drilling data. The following example is for explanatory purposes only and not intended to limit the scope of the disclosed technology.

In FIG. 4A, a well log data (400) includes different types of acquired well data from multiple well sites. For example, the well log data (400) may include data for different types of reservoirs and different types of wells. Initially, the well log data (400) may include a plurality of wells, for example, well 1 (406*a*), well 2 (406*b*), well 3 (406*c*), well 4 (406*d*), and well N (406*n*) and the drilling surface parameters under each well are one parameter data as a function of a depth (402) with a common horizon of interest (404). As explained in Block 310 of FIG. 3, the real-time drilling data are processed and normalized from any time or depth duplicates. Further, the "event/hazard" markers are accurately placed to the processed and normalized real-time drilling data and all data based on the horizon of interest (404) are flattened using an algorithm for filtering the data for an event-based flattening. For example, the algorithm for filtering the data may be based on, such as artificial intelligence, convolutional neural networks, deep neural networks, support vector machines, decision trees, inductive learning models, deductive learning models, and supervised learning models.

In some embodiments, the processing and normalization may include pseudorandom process and processes tailored to specific criteria. In some embodiments, for example, the normalization operations may be a function of geologist requirements. In particular, there may be areas of a formation where deformations and intrusions are expected, and the well data may be processed and normalized accordingly.

FIG. 4B shows a well log data (450) for generation of a pilot signal (454) to train a model by stacking a well log data (450) in accordance with one or more embodiments. In particular, the well log data (450) regarding multiple adjacent wells (for example, 406*a*, 406*b*, 406*c*, 406*n*) in a common horizon of interest (404) are used to determine the pilot signal (454) for the hazardous event. The horizon of interest (404) incorporates the real-time drilling data and historical drilling signals from wells in the same field. Similar procedure is repeated for other events and horizons. Accordingly, in one or more embodiments, the flattening operation is performed based on the horizon of interest (404) on the plurality of historical drilling signals to generate the pilot signal (454) as a robust signature for the wellbore. In particular, the well log data (450) is flattened based on the flattened horizon (452) shown in FIG. 4B and the pilot signals with only coherent signals add up into a form of a three-dimensional matrix of horizons, events, and parameters. The resulting matrix represents the database to which a new well data, for example, in current drilling operations, may be tested against in real-time.

Returning to FIG. 3, in Block 360, adjusted well data or synthetic well data is generated for a region of interest using a model in accordance with one or more embodiments. In particular, a trained model may be used to adjust well data to account for various factors that affect actual rock properties. Likewise, a trained model may also be used to generate synthetic, for example, at areas in a formation outside the sensing capacity of a logging tool. Likewise, synthetic data may be generated for modeling larger regions of interest within a formation.

In some embodiments, the trained model may address overfitting issues with respect to acquired well data. Likewise, the trained model may be used for data labelling within a well dataset or identifying discrepancies with the acquired well data. In one or more embodiments, the trained model may be used for determining the top of one or more formations within a subsurface, for example, for formation top picking.

In some embodiments, the process described in FIG. 3 may be used to adjust other types of data, such as time-series data used in facies predictions, velocity modeling, or seismic interpretations. For example, seismic data may be augmented for training a model used in performing seismic inversion or a migration algorithm.

Figure 5C:
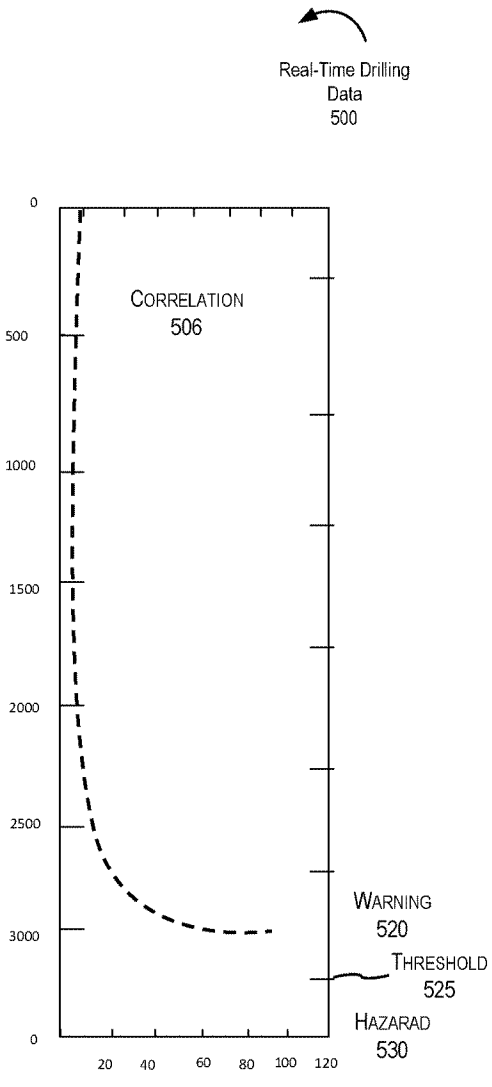
FIGS. 5A, 5B, and 5C show examples in accordance with one or more embodiments.
Figure 5B:
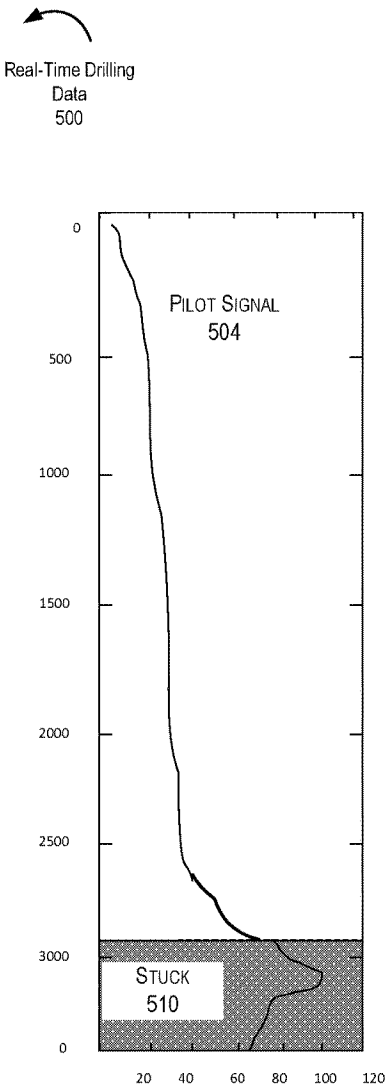
Figure 5A:
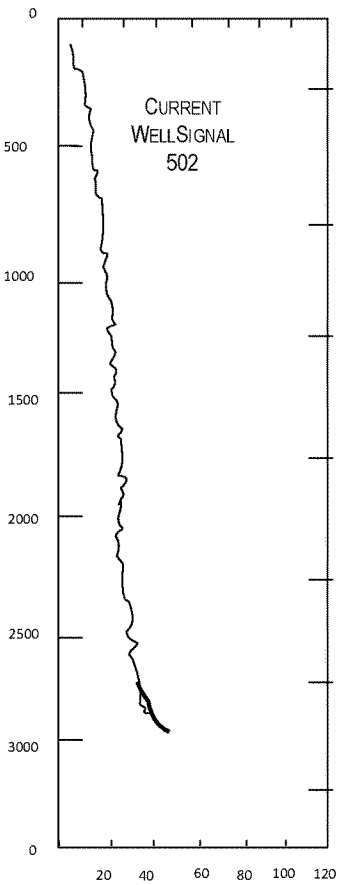

Turning to FIG. 5, FIG. 5A shows correlation of a current well signal (502) with the pilot signature (504) in thick black line and the resulted correlation in accordance with one or more embodiments. In some embodiment, the current well signal (502) for a specific parameter is recorded in a real-time. Further, within one horizon, the well data (real-time drilling parameters/surface data, geological data, and petro-physical data) is be treated as time series, as discussed previously in FIG. 3.

Turning to FIG. 5B, FIG. 5B shows the pilot signature (504) with a previous event stuck (510) in accordance with one or more embodiments. In particular, the well data (real-time drilling parameters/surface data, geological data, and petro-physical data) are correlated with a plurality of event signatures for the same horizon of interest. As mentioned above in Block 320 of FIG. 3, the pilot signal (510) is a linear curve with a function of time within the respective drilling operation.

FIG. 5C shows a real-time drilling data (500) with a result of a correlation (506) between the current well signal (502) and the pilot signal (504) in accordance with one or more embodiments. In some embodiments, a greater value of the correlation (506) indicates a greater correlation or similarity. In some other embodiments, when there is a high correlation prior to a marked event, the logging tool will alert the user by the notification signal (for example, warning (520) or hazard (530)) once a certain threshold (525) exceeds the event probability in the curve form (Block 320), as explained previously in Block 360 of FIG. 3. In some embodiments, the threshold may have a fixed value and is defined by the user.

Figure 6:
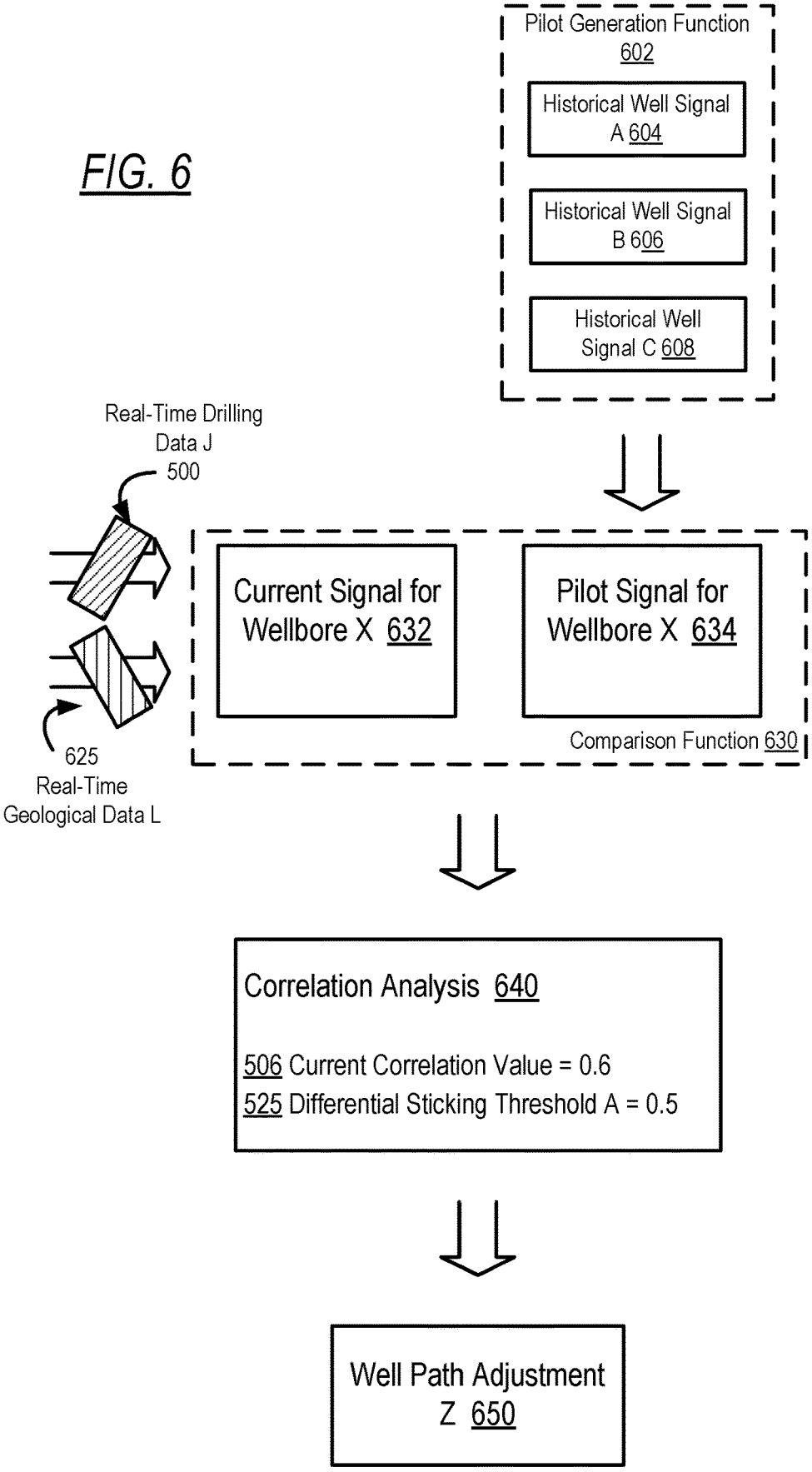
FIG. 6 shows an example in accordance with one or more embodiments.

FIG. 6 provides an example of a reservoir simulator uses geophysical data processing techniques along with algorithms, for example, artificial intelligence (AI) algorithms in a correlation analysis (640) to predict drilling hazard events in real-time based on a real-time drilling data (500) and a real-time geological data (625). In particular, a current signal for wellbore X (632) includes the real-time drilling data J (500) and the real-time geological data L (625). Further, a pilot generation function (602) generates a pilot signal for wellbore X (634) using a historical well signal A (604), a historical well signal B (606), and a historical well signal C (608).

Keeping with FIG. 6, the current signal for wellbore X (632) and the pilot signal for wellbore X (634) are compared in a comparison function (630) and are then analyzed in a correlation analysis (640). In this example, a current value of correlation (506) is 0.6 and a differential sticking threshold A (525) is 0.5. Once the differential sticking threshold A (525) exceeds the current correlation value (506), the logging tool will alert the user by the notification signal regarding the possibility of the drilling hazard condition. Accordingly, a well path of the wellbore is adjusted in response to the notification signal (for example, warning (520) or hazard (530)) in a well path adjustment Z (650).

In the well path adjustment Z (650), one or more geosteering commands, one or more geological maps, or one or more structural models are generated using a trained model in accordance with one or more embodiments. For example, a trained model may be used for multiple different applications. In some embodiments, a trained model is used in handling a large number of geosteering operations. For example, a well path may be adjusted using a trained model, and corresponding geosteering commands may be transmitted by a control system accordingly.

In another embodiment, real-time two-dimensional (2-D) geological maps of a formation or reservoir may be generated using a trained model. In another embodiment, three-dimensional (3-D) structural models may be updated using a trained model instantaneously during drilling operations. Likewise, the trained model may be used to automatically identify interpretation discrepancies in a well database.

Figure 7A:
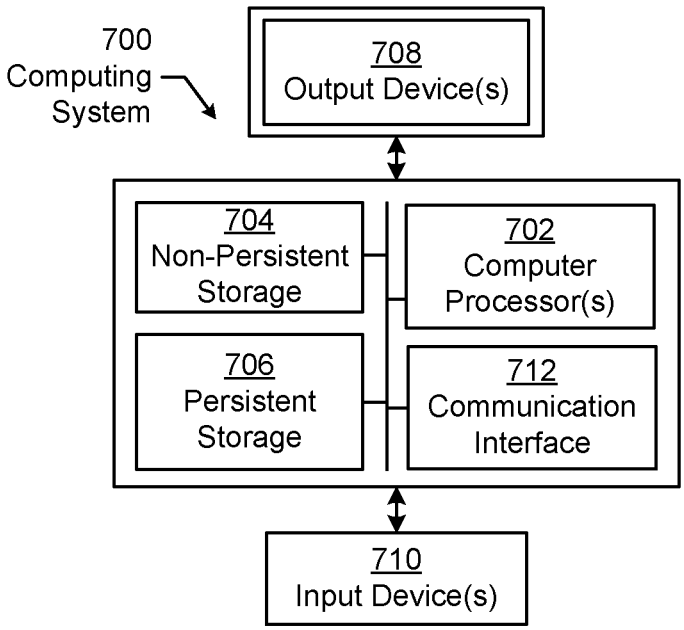
FIGS. 7A and 7B show a computing system in accordance with one or more embodiments.

Embodiments may be implemented on a computing system. Any combination of mobile, desktop, server, router, switch, embedded device, or other types of hardware may be used. For example, as shown in FIG. 7A, the computing system (700) may include one or more computer processors (702), non-persistent storage (704) (for example, volatile memory, such as random access memory (RAM), cache memory), persistent storage (706) (for example, a hard disk, an optical drive such as a compact disk (CD) drive or digital versatile disk (DVD) drive, a flash memory), a communication interface (712) (for example, Bluetooth interface, infrared interface, network interface, optical interface), and numerous other elements and functionalities.

The computer processor(s) (702) may be an integrated circuit for processing instructions. For example, the computer processor(s) may be one or more cores or micro-cores of a processor. The computing system (700) may also include one or more input devices (710), such as a touchscreen, keyboard, mouse, microphone, touchpad, or electronic pen.

The communication interface (712) may include an integrated circuit for connecting the computing system (700) to a network (not shown) (for example, a local area network (LAN), a wide area network (WAN), such as the Internet, mobile network, or any other type of network) or to another device, such as another computing device.

Further, the computing system (700) may include one or more output devices (708), such as a screen (for example, a liquid crystal display (LCD), a plasma display, touchscreen, cathode ray tube (CRT) monitor, or projector), a printer, external storage, or any other output device. One or more of the output devices may be the same or different from the input device(s). The input and output device(s) may be locally or remotely connected to the computer processor(s) (702), non-persistent storage (704), and persistent storage (706). Many different types of computing systems exist, and the aforementioned input and output device(s) may take other forms.

Software instructions in the form of computer readable program code to perform embodiments of the disclosure may be stored, in whole or in part, temporarily or permanently, on a non-transitory computer readable medium such as a CD, DVD, storage device, a diskette, a tape, flash memory, physical memory, or any other computer readable storage medium. Specifically, the software instructions may correspond to computer readable program code that when executed by a processor(s) is configured to perform one or more embodiments of the disclosure.

Figure 7B:
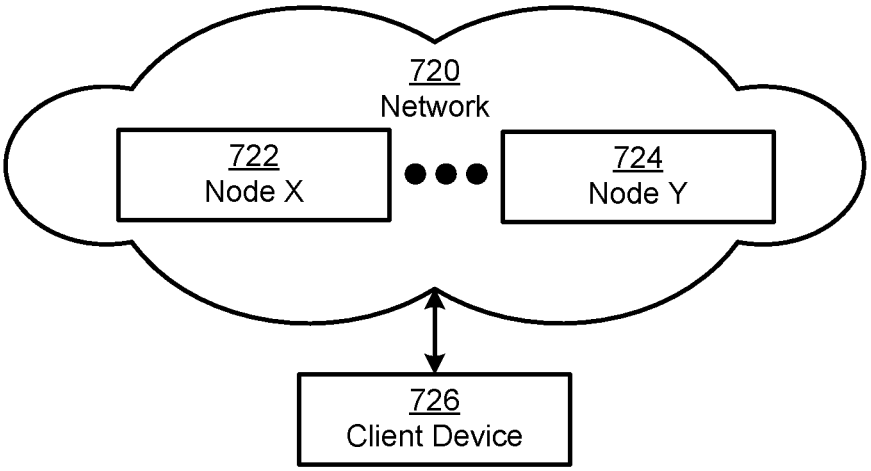

The computing system (700) in FIG. 7A may be connected to or be a part of a network. For example, as shown in FIG. 7B, the network (720) may include multiple nodes (for example, node X (722), node Y (724)). Each node may correspond to a computing system, such as the computing system shown in FIG. 7A, or a group of nodes combined may correspond to the computing system shown in FIG. 7A. By way of an example, embodiments of the disclosure may be implemented on a node of a distributed system that is connected to other nodes. By way of another example, embodiments of the disclosure may be implemented on a distributed computing system having multiple nodes, where each portion of the disclosure may be located on a different node within the distributed computing system. Further, one or more elements of the aforementioned computing system (700) may be located at a remote location and connected to the other elements over a network.

Although not shown in FIG. 7B, the node may correspond to a blade in a server chassis that is connected to other nodes via a backplane. By way of another example, the node may correspond to a server in a data center. By way of another example, the node may correspond to a computer processor or micro-core of a computer processor with shared memory or resources.

The nodes (for example, node X (722), node Y (724)) in the network (720) may be configured to provide services for a client device (726). For example, the nodes may be part of a cloud computing system. The nodes may include functionality to receive requests from the client device (726) and transmit responses to the client device (726). The client device (726) may be a computing system, such as the computing system shown in FIG. 7A. Further, the client device (726) may include or perform all or a portion of one or more embodiments of the disclosure.

The computing system or group of computing systems described in FIGS. 7A and 7B may include functionality to perform a variety of operations disclosed herein. For example, the computing system(s) may perform communication between processes on the same or different systems. A variety of mechanisms, employing some form of active or passive communication, may facilitate the exchange of data between processes on the same device. Examples representative of these inter-process communications include, but are not limited to, the implementation of a file, a signal, a socket, a message queue, a pipeline, a semaphore, shared memory, message passing, and a memory-mapped file. Further details pertaining to a couple of these non-limiting examples are provided in subsequent paragraphs.

Based on the client-server networking model, sockets may serve as interfaces or communication channel endpoints enabling bidirectional data transfer between processes on the same device. Foremost, following the client-server networking model, a server process (for example, a process that provides data) may create a first socket object. Next, the server process binds the first socket object, thereby associating the first socket object with a unique name or address. After creating and binding the first socket object, the server process then waits and listens for incoming connection requests from one or more client processes (for example, processes that seek data). At this point, when a client process wishes to obtain data from a server process, the client process starts by creating a second socket object. The client process then proceeds to generate a connection request that includes at least the second socket object and the unique name or address associated with the first socket object. The client process then transmits the connection request to the server process. Depending on availability, the server process may accept the connection request, establishing a communication channel with the client process, or the server process, busy in handling other operations, may queue the connection request in a buffer until the server process is ready. An established connection informs the client process that communications may commence. In response, the client process may generate a data request specifying the data that the client process wishes to obtain. The data request is subsequently transmitted to the server process. Upon receiving the data request, the server process analyzes the request and gathers the requested data. Finally, the server process then generates a reply including at least the requested data and transmits the reply to the client process. The data may be transferred, more commonly, as datagrams or a stream of characters (for example, bytes).

Shared memory refers to the allocation of virtual memory space in order to substantiate a mechanism for which data may be communicated or accessed by multiple processes. In implementing shared memory, an initializing process first creates a shareable segment in persistent or non-persistent storage. Post creation, the initializing process then mounts the shareable segment, subsequently mapping the shareable segment into the address space associated with the initializing process. Following the mounting, the initializing process proceeds to identify and grant access permission to one or more authorized processes that may also write and read data to and from the shareable segment. Changes made to the data in the shareable segment by one process may immediately affect other processes, which are also linked to the shareable segment. Further, when one of the authorized processes accesses the shareable segment, the shareable segment maps to the address space of that authorized process. Often, one authorized process may mount the shareable segment, other than the initializing process, at any given time.

Other techniques may be used to share data, such as the various data described in the present application, between processes without departing from the scope of the disclosure. The processes may be part of the same or different application and may execute on the same or different computing system.

Rather than or in addition to sharing data between processes, the computing system performing one or more embodiments of the disclosure may include functionality to receive data from a user. For example, in one or more embodiments, a user may submit data via a graphical user interface (GUI) on the user device. Data may be submitted via the graphical user interface by a user selecting one or more graphical user interface widgets or inserting text and other data into graphical user interface widgets using a touchpad, a keyboard, a mouse, or any other input device. In response to selecting a particular item, information regarding the particular item may be obtained from persistent or non-persistent storage by the computer processor. Upon selection of the item by the user, the contents of the obtained data regarding the particular item may be displayed on the user device in response to the selection by the user.

By way of another example, a request to obtain data regarding the particular item may be sent to a server operatively connected to the user device through a network. For example, the user may select a uniform resource locator (URL) link within a web client of the user device, thereby initiating a Hypertext Transfer Protocol (HTTP) or other protocol request being sent to the network host associated with the URL. In response to the request, the server may extract the data regarding the particular selected item and send the data to the device that initiated the request. Once the user device has received the data regarding the particular item, the contents of the received data regarding the particular item may be displayed on the user device in response to the selection by the user. Further to the above example, the data received from the server after selecting the URL link may provide a web page in Hyper Text Markup Language (HTML) that may be rendered by the web client and displayed on the user device.

Once data is obtained, such as by using techniques described previously or from storage, the computing system, in performing one or more embodiments of the disclosure, may extract one or more data items from the obtained data. For example, the extraction may be performed as follows by the computing system (700) in FIG. 7A. First, the organizing pattern (for example, grammar, schema, layout) of the data is determined, which may be based on one or more of the following: position (for example, bit or column position, Nth token in a data stream, etc.), attribute (where the attribute is associated with one or more values), or a hierarchical/tree structure (consisting of layers of nodes at different levels of detail—such as in nested packet headers or nested document sections). Then, the raw, unprocessed stream of data symbols is parsed, in the context of the organizing pattern, into a stream (or layered structure) of tokens (where each token may have an associated token "type").

Next, extraction criteria are used to extract one or more data items from the token stream or structure, where the extraction criteria are processed according to the organizing pattern to extract one or more tokens (or nodes from a layered structure). For position-based data, the token(s) at the position(s) identified by the extraction criteria are extracted. For attribute/value-based data, the token(s) or node(s) associated with the attribute(s) satisfying the extraction criteria are extracted. For hierarchical/layered data, the token(s) associated with the node(s) matching the extraction criteria are extracted. The extraction criteria may be as simple as an identifier string or may be a query presented to a structured data repository (where the data repository may be organized according to a database schema or data format, such as XML).

The extracted data may be used for further processing by the computing system. For example, the computing system of FIG. 7A, while performing one or more embodiments of the disclosure, may perform data comparison. Data comparison may be used to compare two or more data values (for example, A, B). For example, one or more embodiments may determine whether A>B, A=B, A!=B, A<B, etc. The comparison may be performed by submitting A, B, and an opcode specifying an operation related to the comparison into an arithmetic logic unit (ALU) (that is, circuitry that performs arithmetic or bitwise logical operations on the two data values). The ALU outputs the numerical result of the operation or one or more status flags related to the numerical result. For example, the status flags may indicate whether the numerical result is a positive number, a negative number or zero. By selecting the proper opcode and then reading the numerical results or status flags, the comparison may be executed. For example, in order to determine if A>B, B may be subtracted from A (that is, A−B), and the status flags may be read to determine if the result is positive (that is, if A>B, then A−B>0). In one or more embodiments, B may be considered a threshold, and A is deemed to satisfy the threshold if A=B or if A>B, as determined using the ALU. In one or more embodiments of the disclosure, A and B may be vectors, and comparing A with B includes comparing the first element of vector A with the first element of vector B, the second element of vector A with the second element of vector B, etc. In one or more embodiments, if A and B are strings, the binary values of the strings may be compared.

The computing system in FIG. 7A may implement or be connected to a data repository. For example, one type of data repository is a database. A database is a collection of information configured for ease of data retrieval, modification, re-organization, and deletion. Database management system (DBMS) is a software application that provides an interface for users to define, create, query, update, or administer databases.

The user, or software application, may submit a statement or query into the DBMS. Then the DBMS interprets the statement. The statement may be a select statement to request information, update statement, create statement, delete statement, etc. Moreover, the statement may include parameters that specify data, or data container (database, table, record, column, view, etc.), identifier(s), conditions (comparison operators), functions (for example, join, full join, count, average), sort (for example, ascending, descending), or others. The DBMS may execute the statement. For example, the DBMS may access a memory buffer, a reference or index a file for read, write, deletion, or any combination thereof, for responding to the statement. The DBMS may load the data from persistent or non-persistent storage and perform computations to respond to the query. The DBMS may return the result(s) to the user or software application.

The computing system of FIG. 7A may include functionality to present raw or processed data, such as results of comparisons and other processing. For example, presenting data may be accomplished through various presenting methods. Specifically, data may be presented through a user interface provided by a computing device. The user interface may include a GUI that displays information on a display device, such as a computer monitor or a touchscreen on a handheld computer device. The GUI may include various GUI widgets that organize what data is shown as well as how data is presented to a user. Furthermore, the GUI may present data directly to the user, for example, data presented as actual data values through text, or rendered by the computing device into a visual representation of the data, such as through visualizing a data model.

For example, a GUI may first obtain a notification from a software application requesting that a particular data object be presented within the GUI. Next, the GUI may determine a data object type associated with the particular data object, for example, by obtaining data from a data attribute within the data object that identifies the data object type. Then, the GUI may determine any rules designated for displaying that data object type, for example, rules specified by a software framework for a data object class or according to any local parameters defined by the GUI for presenting that data object type. Finally, the GUI may obtain data values from the particular data object and render a visual representation of the data values within a display device according to the designated rules for that data object type.

Data may also be presented through various audio methods. In particular, data may be rendered into an audio format and presented as sound through one or more speakers operably connected to a computing device.

Data may also be presented to a user through haptic methods. For example, haptic methods may include vibrations or other physical signals generated by the computing system. For example, data may be presented to a user using a vibration generated by a handheld computer device with a predefined duration and intensity of the vibration to communicate the data.

The previous description of functions presents only a few examples of functions performed by the computing system of FIG. 7A and the nodes or client device in FIG. 7B. Other functions may be performed using one or more embodiments of the disclosure.

While the disclosure has been described with respect to a limited number of embodiments, those skilled in the art, having benefit of this disclosure, will appreciate that other embodiments can be devised which do not depart from the scope of the disclosure as disclosed. Accordingly, the scope of the disclosure should be limited only by the attached claims.

Although the preceding description has been described herein with reference to particular means, materials and embodiments, it is not intended to be limited to the particulars disclosed herein; rather, it extends to all functionally equivalent structures, methods and uses, such as are within the scope of the appended claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A method, comprising:

obtaining, by a computer processor, a plurality of historical drilling signals for a plurality of wells, wherein at least one historical drilling signal among the plurality of historical drilling signals describes a drilling surface parameter that is measured during a respective drilling operation;

generating, by the computer processor, a first drilling signal while drilling a wellbore through a formation;

determining, by the computer processor, a first drilling correlation between the first drilling signal and the plurality of historical drilling signals;

determining, by the computer processor, a drilling hazard condition within a well path of the wellbore using the first drilling correlation;

adjusting, by the computer processor and based on the drilling hazard condition, the well path of the wellbore;

determining a horizon of interest within the formation; and performing, based on the horizon of interest, a flattening operation on the plurality of historical drilling signals to generate a pilot signal for the wellbore, wherein the first drilling correlation is generated by comparing the first drilling signal with the pilot signal.

2. The method of claim 1, wherein the drilling signal is a time series that corresponds to real-time drilling data, and wherein the plurality of historical drilling signals are functions of time.

3. The method of claim 1, further comprising:

generating, using a logging tool, well log data for a depth interval of interest while drilling the wellbore;

generating a second drilling signal using the well log data, wherein the well log data is converted into a time series, and wherein the second drilling signal is used by a reservoir simulator to determine a second drilling correlation.

4. The method of claim 1, wherein the pilot signal is a linear curve which is a function of time within the respective drilling operation.

5. The method of claim 1, wherein the at least one drilling surface parameter comprises one or more of the following:

a size of the wellbore;

a location of the well;

a torque produced by a drill to turn an object;

a speed at which a drill bit can break a rock to deepen the wellbore;

a standpipe pressure;

an amount of downward force exerted on the drill bit provided by a plurality of drill collars in a drill assembly;

a geological data of the well comprises the well log data and a core sample data; and a petro-physical data of the well.

6. The method of claim 1, further comprising:

generating a notification signal in response to detection of a drilling hazard condition;

clarifying a drilling correlation operation to generate a final probability of a drilling hazard event; and using a probability threshold to determine the drilling hazard condition.

7. A system, comprising:

a drilling system;

a logging system comprising a plurality of drill bit logging tools, wherein the logging system is coupled to the drilling system;

a control system coupled to a plurality of sensors; and a reservoir simulator comprising a computer processor, wherein the reservoir simulator is coupled to the logging system and the drilling system and comprises functionality for:

obtaining, by a computer processor, a plurality of historical drilling signals for a plurality of wells, wherein at least one historical drilling signal among the plurality of historical drilling signals describes a drilling surface parameter that is measured during a respective drilling operation;

generating, by the computer processor, a first drilling signal while drilling a wellbore through a formation;

determining, by the computer processor, a first drilling correlation between the first drilling signal and the plurality of historical drilling signals;

determining, by the computer processor, a drilling hazard condition within a well path of the wellbore using the first drilling correlation;

adjusting, by the computer processor and based on the drilling hazard condition, the well path of the wellbore;

determining, by the computer processor, a horizon of interest within the formation; and determining, by the computer processor, a pilot signal for the wellbore, based on the horizon of interest, by flattening the plurality of historical drilling signals to generate, wherein the first drilling correlation is generated by comparing the first drilling signal with the pilot signal.

8. The system of claim 7, wherein the drill bit logging tool is operable to generate well log data for a depth interval of interest while the drilling system is drilling the wellbore, and wherein the reservoir simulator is configured to convert the well log data into a time series.

9. The system of claim 7, wherein the reservoir simulator is configured to:

generate a second drilling signal using the well log data, wherein the second drilling signal is used by the reservoir simulator to determine a second drilling correlation.

10. The system of claim 7, wherein the pilot signal is a linear curve which is a function of time within the respective drilling operation.

11. The system of claim 7, wherein the reservoir simulator is configured to:

generate a notification signal in response to detection of a drilling hazard condition;

generate a final probability of a drilling hazard event by clarifying a drilling correlation operation; and determine the drilling hazard condition by using a probability threshold.

12. A non-transitory computer readable medium storing instructions executable by a computer processor, the instructions comprising functionality for:

obtaining a plurality of historical drilling signals for a plurality of wells, wherein at least one historical drilling signal among the plurality of historical drilling signals describes a drilling surface parameter that is measured during a respective drilling operation;

generating a first drilling signal while drilling a wellbore through a formation;

determining a first drilling correlation between the first drilling signal and the plurality of historical drilling signals;

determining a drilling hazard condition within a well path of the wellbore using the first drilling correlation;

determining a horizon of interest within the formation; and performing, based on the horizon of interest, a flattening operation on the plurality of historical drilling signals to generate a pilot signal for the wellbore, wherein the first drilling correlation is generated by comparing the first drilling signal with the pilot signal.

13. The non-transitory computer readable medium of claim 12, wherein the drilling signal is a time series that corresponds to real-time drilling data, and wherein the plurality of historical drilling signals are functions of time.

14. The non-transitory computer readable medium of claim 12, wherein the instructions further comprise functionality for:

generating, using a logging tool, well log data for a depth interval of interest while drilling the wellbore;

generating a second drilling signal using the well log data, wherein the well log data is converted into a time series, and wherein the second drilling signal is used by a reservoir simulator to determine a second drilling correlation.

15. The non-transitory computer readable medium of claim 12, wherein the pilot signal is a linear curve which is a function of time within the respective drilling operation.

16. The non-transitory computer readable medium of claim 12, wherein the at least one drilling surface parameter comprises one or more of the following:

a size of the wellbore;

a location of the well;

a torque produced by a drill to turn an object;

a speed at which a drill bit can break a rock to deepen the wellbore;

a standpipe pressure;

an amount of downward force exerted on the drill bit provided by a plurality of drill collars in a drill assembly;

a geological data of the well comprises the well log data and a core sample data; and a petro-physical data of the well.

17. The non-transitory computer readable medium of claim 12, wherein the instructions further comprise functionality for:

generating a notification signal in response to detection of a drilling hazard condition;

clarifying a drilling correlation operation to generate a final probability of a drilling hazard event; and using a probability threshold to determine the drilling hazard condition.

* * * * *